US006408460B1

(12) United States Patent
Naoum

(10) Patent No.: US 6,408,460 B1
(45) Date of Patent: Jun. 25, 2002

(54) COLLECTOR OF UNUSED WATER

(76) Inventor: Dimitrios Naoum, 551 32 Kalamaria, Thessaloniki (GR)

( * ) Notice: Subject to any disclaimer, the term of this patent is extended or adjusted under 35 U.S.C. 154(b) by 0 days.

(21) Appl. No.: 09/743,291

(22) PCT Filed: Jul. 5, 1999

(86) PCT No.: PCT/GR99/00024

§ 371 (c)(1),
(2), (4) Date: Jan. 8, 2001

(87) PCT Pub. No.: WO00/03098

PCT Pub. Date: Jan. 20, 2000

(30) Foreign Application Priority Data

Jul. 9, 1998 (GR) ..... 980100268

(51) Int. Cl.[7] ..... A47K 4/00
(52) U.S. Cl. ..... 4/665
(58) Field of Search ..... 4/665

(56) References Cited

U.S. PATENT DOCUMENTS 5,274,861 A * 1/1994 Ford ..... 4/665
5,345,625 A * 9/1994 Diemand ..... 4/665
5,406,657 A * 4/1995 Donati ..... 4/665

FOREIGN PATENT DOCUMENTS

DE 4134272 * 4/1993 ..... 4/665
GB 2309731 * 6/1997

* cited by examiner

*Primary Examiner*—Charles E. Phillips
(74) *Attorney, Agent, or Firm*—Adams & Wilks

(57) ABSTRACT

A device for collecting unused water is placed underneath all kinds of taps and collects the pure unused water which escapes during the intermediate intervals of use of the tap. The device comprises two spherical sections connected to each other for collecting clean water and preventing the entry of used water into the head of the collector. The device has a flexible pipe which drives the water outside the place of use to a drain which leads it to a storage area. The collection of the water is achieved by taking advantage of the concentrated energy of the column of the water at one point, such as the moment the tap is turned on and the water is not yet being used. The opposite prevents the entry of the used water. The device may be used both household uses (kitchen, bathroom) and places of personal hygiene for the personnel of factories and the like.

6 Claims, 3 Drawing Sheets

| Use | Overall water consumption | Overall time | Time of actual use | Water for actual use | Collected water |
|---|---|---|---|---|---|
| hand washing | 2,8L | 20'' | 5'' | 0,8L | 1,2L |
| face washing | 3,3L | 24'' | 5'' | 0,8L | 1,6L |
| teeth brushing | 3,0L | 22'' | 7'' | 1,1L | 1,2L |
| shaving | 5,0L | 36'' | 23'' | 3,6L | 1,0L |
| wait for hot water | 2,1L | 15'' | — | — | 1,2L |

FIGURE 3

COLLECTOR OF UNUSED WATER

BACKGROUND OF THE INVENTION

The invention pertains to a collector of unused water consisting of a head and a remaining part. The head consists of two spherical sections firmly connected to each other: 1) A small section which constitutes the upper part of the head of the collector and comprising a regulator of the incoming water having in its center a through hole whose lips are curved at the top, a water tank having an inlet and an outlet with overflow for the filling of the inlet pipe with water, and a water disturbance absorber from below and 2) a large section, which is the base of the head of the collector, carrying four anti-skid legs of adjustable height for the levelling of the head of the collector and an open-turn pipe which is connected to the water tank which is in the upper part of the head with a small cross-section pipe.

The remaining part of the collector consists of a very flexible pipe connecting the head to the drain, which consists of a pipe inside which there is an open-turn elbow with an extension along the run of the pipe and a side inlet. In the upper part there is an overflow valve. The drain is connected through a flexible pipe to a water storage tank.

From time to time, attempts have been made to lower water consumption, especially that of the households. Mechanisms and ways have been invented, some of which lower the pressure of the water and create spray by inserting air in the pipes, thus creating the impression of quantity while in others there are reduced cross-sections in the water intake pipes (thermomixing sluice valves) where the typical position for use is either open or close, making it impossible for the user to choose another position in between. There are also electromechanical or mechanical switches at the end of the tap.

These mechanisms have the following essential drawbacks:

1) Spray filters need frequent maintenance (screen cleaning.)
2) The reduced cross-sections in the thermomixing sluice valves do not provide economy, they just reduce the waste since they usually function only when fully open.
3) Taps with electromechanical mechanisms cost a lot to buy, require an electric installation all the way to the tap and cannot respond to the multiplicity of household uses. They are, however, suitable for public places with simple uses (washing of hands) and are installed mainly for hygienic purposes.
4) The mechanical mechanisms at the end of the tap not only are they not convenient for the user (the switch is activated by a flexible foil, or something similar, hanging from the tap and hampers most uses) but they also inflict hydraulic damage on the installation due to their abrupt opening and closing.

The dominant mechanisms for water economy to-date are those which create spray water in a variety of ways, giving the impression of quantity. The water saved in this way is little because 1) after the first impressions have subsided, the user seeks the weight of the water he was used to, which leads to a prolongation of the time of the use or the increase in the water flow, and 2) the main problem, which is the wasting of pure water during the intermediate stages of a use, is not countered. Usually, the user either does not reach to turn off the tap during the time he is not using the water, e.g., when washing his hands or shaving, or does not have the time to do so because the time periods are too short, e.g., when washing his face or because he does not wish to alter the water mix in simple taps. The result is that the water wasted in the intermediate stages, when it is not used, is, as a rule, more than the water needed for the use itself. A noteworthy case of water wasting is the one in which we turn on the hot water switch and wait for it to come from the heater. If, furthermore, we have a solar heater, then the waste is especially big.

BRIEF DESCRIPTION OF THE DRAWINGS

FIG. 3 is a chart showing water usage for various household uses.

DETAILED DESCRIPTION OF THE INVENTION

Figure 1:
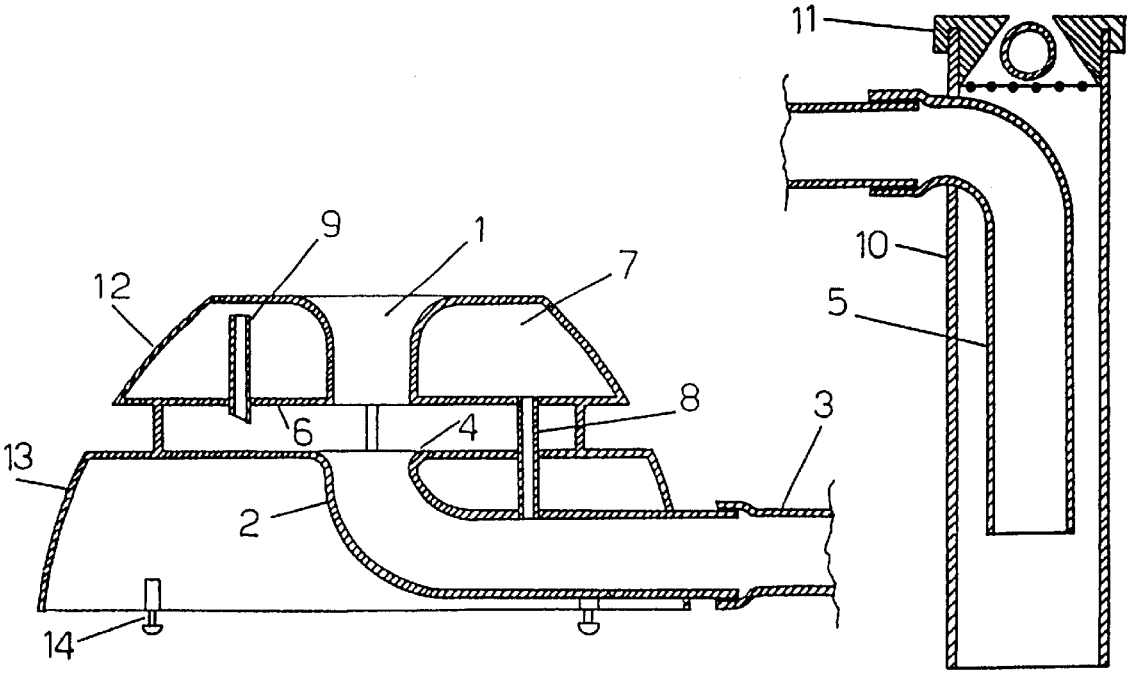
FIG. 1 is a cross-sectional view of one embodiment of a collector of unused water according to the present invention.

FIG. 1 shows the collector of unused water. Its function is illustrated below. The water passes through the regulator (1) of the incoming water flow. The lips of the regulator are curved so that the water enters the pipe (2) without having its flow obstructed even in the event that the column of water is not exactly in the center or diverses a little with the increase of the water supply if the tap has a declination. Then the water, with the power it carries, fills the open-turn elbow (2), the elastic pipe (3) and the open-turn elbow (5). As soon as this happens, there is pressure and an intense water rip forms in the mouth of the open turn elbow (2). The lips of the mouth of the open turn elbow (2) are slightly curved (4) so that the rip is reflected to and damped in the lower part (6) of the small spherical section of the head of the collector. Then an outflow of water occurs from the extension of the open-turn elbow (5). At the same time, tank (7) is filled through pipe (8) and when this is done there is an outflow of water from the overflow pipe (9). The waste pipe (10) plays a triple role: 1) It leads the collected water, through an elastic pipe or without one to a storage place; 2) it does not allow an uptake (during the stoppage of the water column from the tap to the head of the collector) of the water inside the elastic pipe; and 3) it has on its upper part an overflow valve (11) which when closed does not allow any more water inside the drain pipe (10) when the water storage place is full.

The stage of the creation of the column of water from the turning on of the tap until the outflow from the open-turn pipe (5) lasts about 0.35 sec. During the stoppage stage, e.g., when we put our hands under the tap in order to rinse them, the dirty water cannot enter the head of the collector for two reasons: 1) The water does not have the power to push the water which is inside the open-turn elbow (2) and the elastic pipe (3) since it runs diffusely, and 2) with the stoppage of the water column, the water inside the elastic pipe (3) returns and empties over the lips (4) of the open-turn elbow (2), flushing from the head of the collector the dirty water running at the moment. Even when the flushing lasts a long time, dirty water cannot enter because there still is water in part of pipe (3) and in the open-turn elbow (2) (a pipette is created). The level of the remaining water does not reach the lips (4) of the open-turn elbow (2), but stays lower, because the greater speed of the water during the emptying of pipe (3) forces the water, which would normally cover the pipette if it returned slowly, to overflow. This water covers the water which is inside tank (7) (volume of about 20 $cm^3$) which empties through pipe (8) and adds to it the amount missing to achieve an overflow through lips (4), thus preventing dirty water from entering the open-turn elbow (2).

Figure 2:
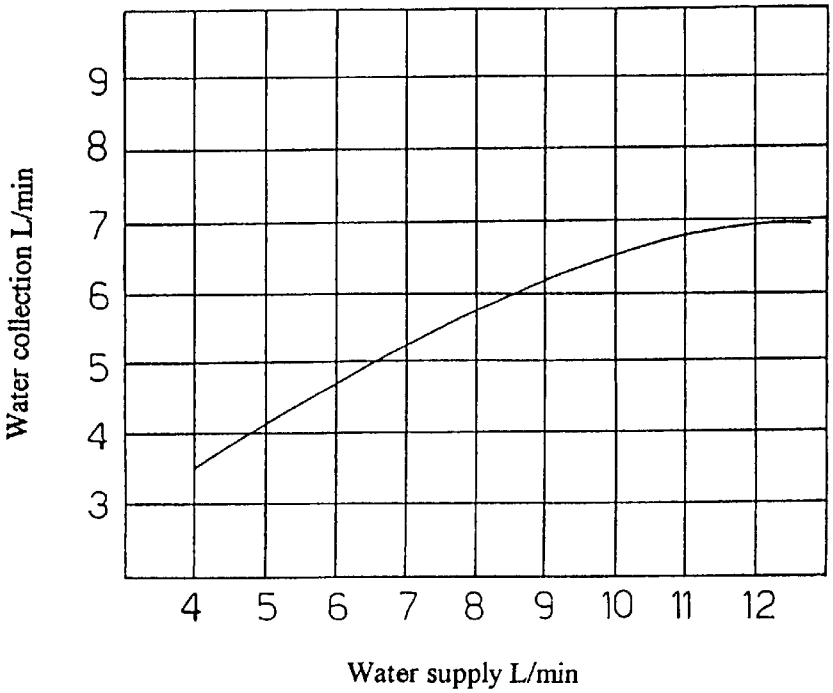
FIG. 2 is a graph showing the relation between water collection versus water supply.

The collector of unused water functions extremely effectively even with a very small water flow, of the order of 2.8 L/min., and the lowest tap possible. It is designed so as to have its maximum performance at little and medium water flow (small and medium tap opening), as shown in the output curve of FIG. 2. As for the particular cases where there is a drain of bigger cross-section in the kitchen sink (e.g., existence of a garbage disposal unit) and the path of the outflow mouth of the tap happens to pass close to the periphery of the drain so that the four anti-skid legs (14) of the head of the collector cannot be solidly attached when it is placed under the mouth of the tap, a simple ring of bigger diameter than the base of the collector is placed on the base of the collector (13), thus moving the four anti-skid legs to a new base of a bigger diameter.

Also, in case the column of water is too close to the walls of the sink, a short bent tube can be placed in such a way as to reach and fit the water inlet of the head of the collector (1).

Finally, in case of great inclination of the tap, it is suggested that a short bent extension be placed at the end of the tap to achieve better verticality. FIG. 3 illustrates certain facts pertaining to specific everyday household uses. The measurements were made with conservative use of a simple tap whose outflow mouth was 39 cm. above the bottom of the sink. The water supply network pressure was 1.8 BAR at periods of rest and the internal diameter of the two open-turn elbows (2) and (5) as well as that of the flexible pipe (3) was 10 mm. These measurements did not take into account the fact that in each of the uses, as long as they were not too close to each other in time, there is an amount of water added to the collected one due to the wait for hot water during the winter.

The overall consumption of water shown in FIG. 3, regardless of use, is representative as it depends exclusively on the user. The numbers in the other columns are interesting. Looking, for example, at the use—face washing—we see that when we consume 3.3 L, only 0.8 L are used for the actual use. The remaining 2.5 L are wasted during the intermediate times. The collector of unused water can collect 1.6 L of these 2.5 L. We, therefore, save 64% of the water which was not used in this particular use or a 48.5% economy in the water in the overall use of the paradigm without shortening the time of use. In case there is a period of wait for hot water, the amount of collected water is much greater.

The collector of unused water is suitable both for household use (kitchen, bathroom) and for spaces of personal hygiene in small and big factories, etc., without it being binding.

The collector of unused water is a device of small volume, light, handy and can be installed in all kinds of lavatory washbowls, kitchen sinks or places having to do with personal hygiene. The only thing a user has to do, is to place the head of the collector of unused water under the tap. The head of the collector can be moved and placed beside the tap, e.g., when we want to clean the place, very simply and easily.

The collector of unused water is a device with low manufacturing cost, simple and in need of no maintenance.

There are various solution to the problems of storage and distribution of the water. The size and the shape of the tanks as well as the hauling of the water are variables which can be modified to suit the solution we wish to achieve. The use of bigger spaces such as the lower part of the bathtub or the washbowl provides the ability to store more liters of water. The use of small pumps or pumps controlled by pressureless mechanisms to haul the water further away or to higher points such as the water tank in the closet above the lavatory allows greater flexibility.

Of course, the simple and economical solution of placing a bucket by the collection point for immediate use is by no means ruled out.

Below are described two ways of application of the invention, with references to the drawings, which are in no way restrictive.

EXAMPLE 1

Application in Household Use

Figure 4:
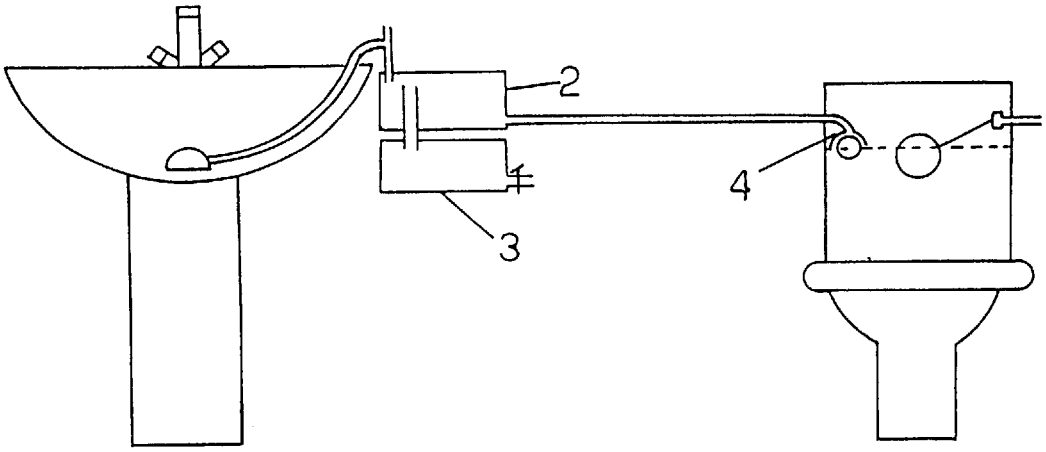
FIG. 4 is an explanatory view showing use of the collector of unused water with a water-closet.

In the bathroom (FIG. 4)

The layout shows: the collector of unused water, two 10 L tanks (suggested dimensions: 0.20×0.35×0.15 m.), a plastic pipe and a water level switch. The height of the tank (2) is less or equal to the difference between the height of the lip of the washbowl from the floor and the height of the level of the water in the water-closet from the floor. The water is gathered by the collector of unused water and driven to tank (2). The water stored in this tank is exclusively for the flush water-closet. When this is filled, the water overflows and fills tank (3) from which it can be used to clean the house, for instance.

When the water from the water-closet empties, switch (4) opens and the water from tank (2) empties into the water-closet due to gravity.

The amount of water which can be collected in the bathroom in a family of four can be deduced approximately by using the facts in the last column of FIG. 3:

| | | |
|---|---|---|
| hand washing | 8 uses × 1.2L | = 9.6L |
| face washing | 8 uses × 1.6L | = 12.8L |
| teeth brushing | 8 uses × 1.2L | = 9.6L |
| shaving | 2 uses × 1.0L | = 2.0L |
| wait for hot water | estimated | = 5.0L |
| house cleaning intermediate uses | 5 uses × 1.2L | = 6.0L |
| | | Total 45L |

Figure 5:
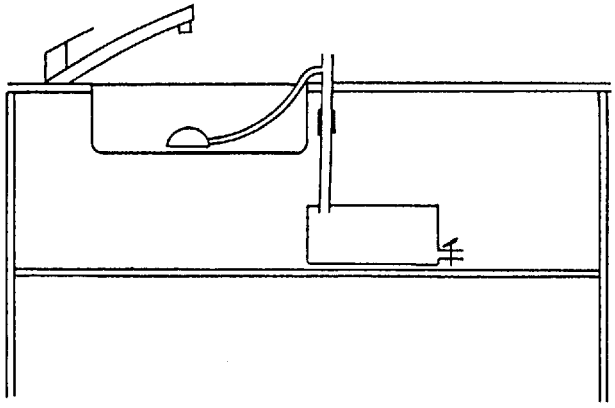
FIG. 5 is an explanatory view showing use of the collector of unused water with a kitchen sink.

In the Kitchen (FIG. 5)

The collection and storage of water in the kitchen is done in a similar way. The tank can be installed underneath the kitchen sink. A sluice valve is fitted in the lower part of the tank, from which we can get the collected water. The quantity of the water gathered in the kitchen of a house of a family of four, which uses a dishwasher, has been measured and it amounts, overall, for a whole day, to approximately 25 L.

Therefore, the water collected daily appears to be in the order of 70 L. This means that with the water we have collected we can cover our daily needs for the water closet (with rational use) and the cleaning of the house.

For a family of four with an average consumption of 35 $m^3$ per quarter, this amounts to a water economy of 70 L×120 days=8,400 L, or 8.4 $m^3$, which amounts to a 24% reduction in the overall consumption of water.

EXAMPLE 2

Figure 6:
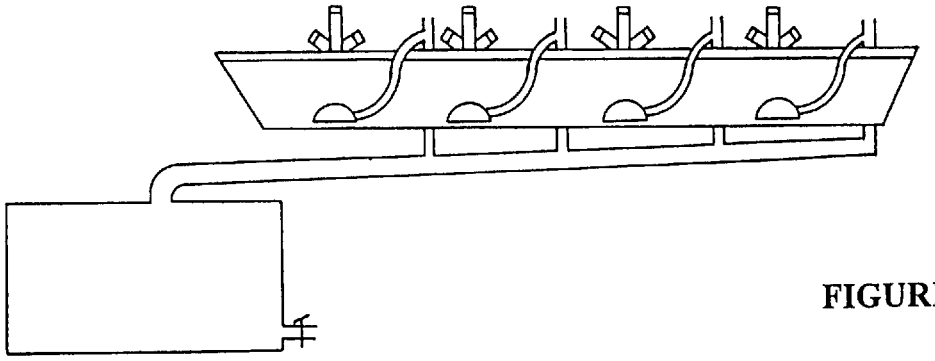
FIG. 6 is an explanatory view showing use of the collector of unused water in a factory.

In places of personal hygiene in large and and small factories, etc. (FIG. 6)

Due to the nature of the work, most of the time for individual hygiene is particularly time-consuming and, consequently, the quantity of the collected water is large. The water can be collected with lined-up collectors of unused water and led to a common pipe which will fill a water tank that will supply the bathrooms or other needy places of the enterprise. The layout is shown in FIG. 6.

What is claimed is:

1. A collector of unused water comprising: a head and a remaining part; the head comprising small and large sections; the small section constituting the upper part of the head of the collector and comprising a regulator for incoming water and having in its center a through hole having lips which are curved at the top, a water tank having an inlet during the filling and an outlet with overflow for the filling of an inlet pipe with water, and a water disturbance absorber; the large section constituting the base of the head of the collector and carrying anti-skid legs, an open-turn pipe having upper lips which are slightly curved, and a small cross-section pipe connecting the open-turn pipe to the water tank; and the remaining part comprising a flexible pipe connecting the head to a drain, the drain comprising a pipe inside of which extends an open-turn elbow with an extension along the run of the pipe and a side inlet, and an overflow valve in the upper part of the drain, the drain being connected, with or without a flexible pipe, to a water storage tank.

2. A collector of unused water according to claim 1, including a base ring to better secure the collector in case of a larger cross-section drain.

3. A collector of unused water according to any one of claims 1 and 2, including a short bent extension which can fit in the tap to improve the verticality of the column of water.

4. A collector of unused water according to any one of claims 1 and 2, including a bent inlet water pipe which can fit in the water inlet of the upper part of the collector to draw water in case the column of the water is close to the walls of a washbowl.

5. A collector of unused water according to any one of claims 1 and 2, including small similar tanks that can be combined or used separately.

6. A collector of unused water according to any one of claims 1 and 2, including a large capacity tank which occupies the empty space of the lower part of a bathtub or the back side of a washbowl.

* * * * *